US007311130B2

(12) United States Patent
Hoermann

(10) Patent No.: US 7,311,130 B2
(45) Date of Patent: Dec. 25, 2007

(54) CONTROLLED DRIVE FOR A GARAGE DOOR PANEL FOR THE LIKE

(75) Inventor: Michael Hoermann, Oerlinghausen (DE)

(73) Assignee: Marantec Antriebs-und Steuerungstechnik GmbH & Co. KG, Marienfeld (DE)

( * ) Notice: Subject to any disclaimer, the term of this patent is extended or adjusted under 35 U.S.C. 154(b) by 672 days.

(21) Appl. No.: 10/781,016

(22) Filed: Feb. 18, 2004

(65) Prior Publication Data

US 2004/0251865 A1 Dec. 16, 2004

(30) Foreign Application Priority Data

Feb. 18, 2003 (DE) ..... 203 02 633 U

(51) Int. Cl.
*E05F 15/20* (2006.01)

(52) U.S. Cl. ..... 160/7; 49/200; 200/38 BA

(58) Field of Classification Search ..... 160/188, 160/189, 7, 1, 310; 49/199, 200, 324, 28; 200/47, 38 BA; 318/266, 466; 74/89.15, 74/425, 89.14, 568

See application file for complete search history.

(56) References Cited

U.S. PATENT DOCUMENTS 2,882,044 A * 4/1959 Ginte ..... 318/266
3,733,747 A * 5/1973 Fox et al. ..... 49/30
3,846,597 A * 11/1974 Ziegler, Jr. ..... 200/38 BA
3,988,553 A * 10/1976 Astle ..... 200/38 BA
4,159,598 A * 7/1979 Gatland et al. ..... 49/28
4,344,252 A * 8/1982 Suzuki et al. ..... 49/199
4,628,636 A * 12/1986 Folger ..... 49/199
5,243,784 A * 9/1993 Whitaker et al. ..... 49/199
7,091,688 B2 * 8/2006 Gioia et al. ..... 318/466
7,161,100 B1 * 1/2007 Hsieh ..... 200/47
2006/0049021 A1 * 3/2006 Scheib et al. ..... 192/139

FOREIGN PATENT DOCUMENTS

DE 3208094 9/1983
DE 3810561 10/1989

* cited by examiner

*Primary Examiner*—David Purol
(74) *Attorney, Agent, or Firm*—Dilworth & Barrese LLP

(57) ABSTRACT

The invention relates to a system to control the motor drive of a garage door panel which is reciprocatingly movable and guided along a predetermined track between two end positions, and possibly, one or more intermediate stop positions, said garage door panel including a switching device which indicates the assumption of the respective end position or stop positions, the output signals of this switching device being usable to switch off the power supply to the drive motor, wherein the limit switches or reference point switches are actuatable through rotatable cams which simulate the garage door path. According to the invention, both the rotating cams as well as the limit switches are combined to form one constructional unit.

16 Claims, 2 Drawing Sheets

CONTROLLED DRIVE FOR A GARAGE DOOR PANEL FOR THE LIKE

BACKGROUND OF THE INVENTION

The invention relates to a system to control the motor drive of a garage door panel which is reciprocatingly movable and guided along a predetermined track between two end positions, and possibly one or more intermediate stop positions, said garage door panel including switching devices which indicate the assumption of the respective end position or stop positions, the output signals of these switching devices being usable to switch off the power supply to the drive motor, wherein the limit switches or reference point switches are actuatable through rotatable cams which simulate the garage door path.

Systems of this type by which the garage door panel's path of motion is simulated are already known. Here, a motion variable corresponding to the motion of the garage door panel, and derived from its drive, is subject to a high reduction in gear ratio and utilized to rotate a cam, the motional path of which reproduces the actual measured distance of the moved garage door panel. This cam which functions as the simulator element, in other words, also moves between two end positions corresponding to those of the garage door panel, at which positions it actuates switching devices which thus reproduce the two end positions of the garage door panel. In addition to the end positions, any desired intermediate stop positions for the garage door panel may be attained.

A simulator of this type, which may be preferably disposed in the region of the drive or of the drive control, is in fact, protected from damage, contamination and moisture. After installation of the garage door, however, the simulator requires an especially precise position adjustment corresponding to the garage door—for example, in such a way that the start of the path of motion for the garage door panel must exactly match the start of the displacement path of the simulator. Given the high path transmission ratios here, even small deviations result in the danger that the garage door panel will be driven beyond its end positions, thereby colliding with a guide or other object, or that the desired intermediate position for the garage door panel will not be precisely attained. So-called zeroing between the garage door panel and the rotating cam thus requires particular care and sensitivity. The various cams for the reference points End Position Up, End Position Down, or the intermediate positions are usually located on a shaft which is linked through a reduction gearing to the gear unit. A known approach is to adjust the cams using a tool such as a hex key wrench. However, the necessary sensitive and precise adjustment for the precision-mechanical system presents certain problems. These problems are further aggravated by the fact that the drive units are generally installed several meters above ground level.

SUMMARY OF THE INVENTION

The goal of the invention is therefore to modify a system in such a way to provide a sensitive and precise adjustment of the rotating cam in the system.

According to the invention, the goal is achieved by the combination of features herein. To this end, both the rotating cams as well as the limit switches are combined into one constructional unit. This complete unit is preferably able to be inserted or clipped on, thus enabling easy installation. In many cases, it is able to be easily removed, appropriately adjusted, and then moved to its operating position. As a result, the corresponding rotating cams are able to be adjusted extremely precisely.

Advantageous embodiments of the invention are described herein.

It is especially advantageous if the rotating cams combined within the constructional unit are able to be adjusted by both a rough adjustment and a fine adjustment. This property provides for an especially sensitive and highly precise adjustment of the positions to be attained.

In an especially advantageous embodiment of the invention, the individual rotating cams are composed of one cam wheel each which is frictionally engaged to a disk which in turn is rotationally fixed on a driven spindle. The frictional engagement here may be produced by an O-ring.

The rough adjustment is advantageously provided by a rough-adjustment wheel molded on to the cam wheel, part of the rough adjustment wheel projecting from the housing.

Wheels to effect fine adjustment may be resiliently mounted in a comb-like spring connector strip suspended in the housing such that these wheels project at least partially from the housing. They are able to be rotated in response to pressure against the spring resistance of the spring connector strip, and are able to be moved along with the corresponding cam wheel into the operational or frictionally engaged position to effect fine adjustment of the cam position.

One wheel pair each may be advantageously provided to effect fine adjustment.

Multiple cam wheels may be arranged side by side so as to actuate the different switches. Finally, an actuator may be additionally located in the housing to allow for quick release.

BRIEF DESCRIPTION OF THE DRAWINGS

Additional details and advantages of the invention will be presented based on an embodiment shown in the drawing.

DESCRIPTION OF THE PREFERRED EMBODIMENTS

Figure 1:
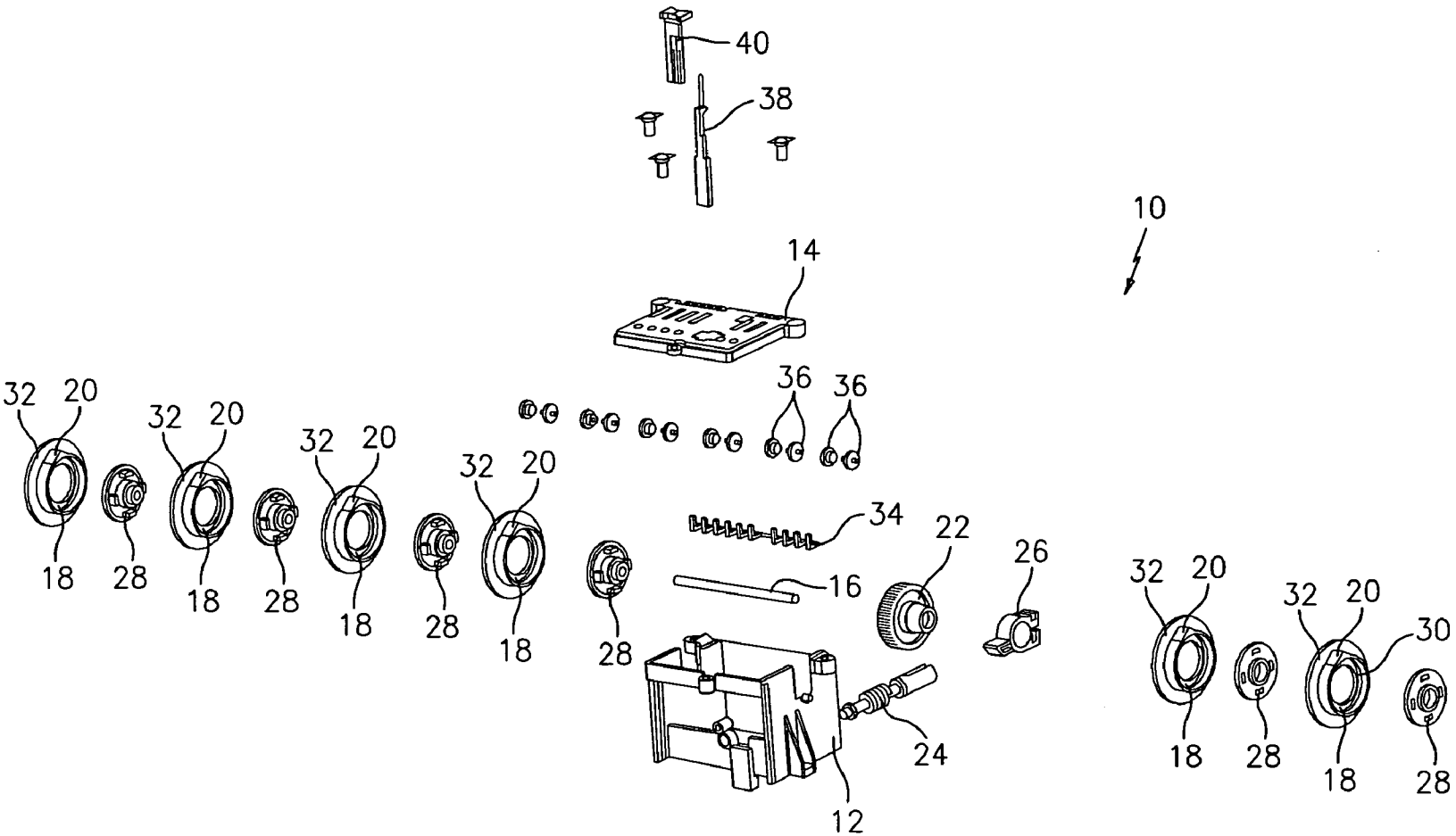
FIG. 1: is an exploded view of constructional unit according to the invention, and FIGS. 2 and 3 provide a perspective view of a constructional unit according to the invention in the assembled state.

FIG. 1 shows an embodiment of a constructional unit 10 which may be employed in a system according to the invention to control the motor drive of a movable garage door panel moved reciprocatingly along a certain track between two end positions, and possibly one or more intermediate stop positions, said garage door panel including a switching device indicating the assumption of the corresponding end position or one of the stop positions. Constructional unit 10 is enclosed by a housing 12 closable by a housing cover 14. A series of cam wheels 18, each having a radial cam 20 is located within housing 12 on a drive spindle 16. Spindle 16 is rotationally fixed to a gear 22 of a reduction gear composed of this gear 22 and a worm wheel 24. The reduction gear is connected to a main drive gear unit, not shown.

Disks 28 are also rotationally fixed to spindle 16. One cam wheel 18 each is able to be pressed against and frictionally engaged to these disks 28, the frictional engagement in the embodiment shown being effected by an O-ring. Also mounted on rotationally fixed disks 28 are the respective cam wheels 18 which are each also frictionally engaged with disks 28 in the conventional manner such that cam 20 remains in position and also rotates along with disks 28 which rotate in response to the rotation of spindle 16. As a result, the motion of the main drive gear unit is reproduced in reduced fashion on spindle 16 through reduction gear 22, 24, cams 20 rotating in response to the main drive gear unit. Rough-adjustment wheels 32 are molded on to each cam wheel 18 respectively, the rough adjustment wheels projecting from housing cover 14—as seen especially clearly in FIGS. 2 and 3. This arrangement allows a rough adjustment of cams 20 to be performed from outside, the frictional engagement between cam wheel 18 and disk 28 rotationally fixed to spindle 16 being overcome in response to appropriate actuation of rough-adjustment wheels 32 by an operator.

Figure 2:
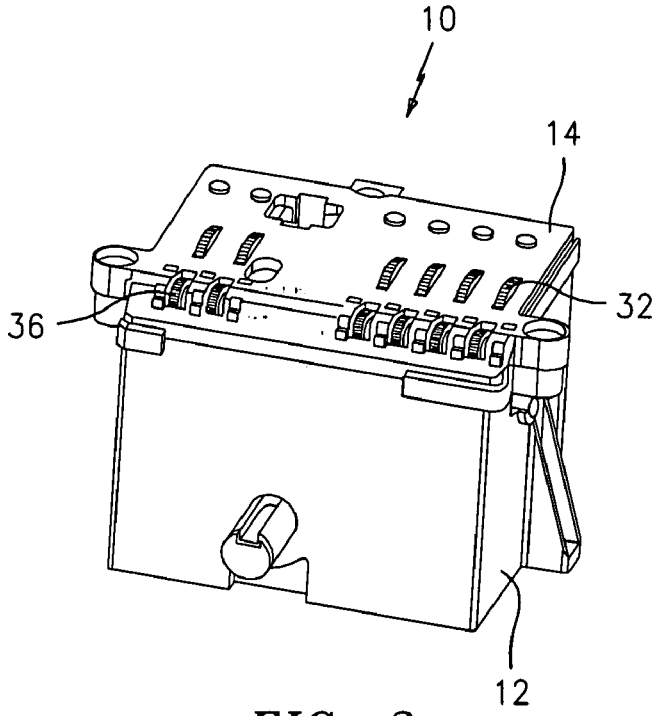
Figure 3:
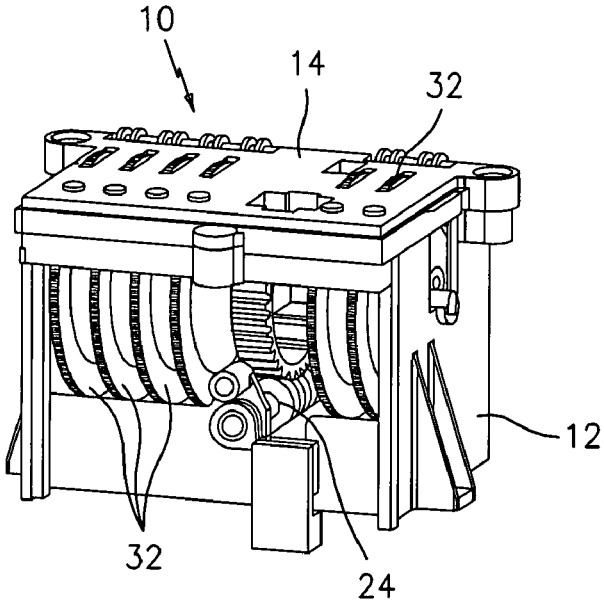

In addition, pairs of fine-adjustment wheels 36 are mounted in housing 12 by a comb-like spring connector strip 34 which is suspended in the housing, these fine-adjustment wheels similarly projecting from housing cover 14, as shown in FIGS. 2 and 3. These wheels for fine adjustment 36 which have a comparatively small diameter, as is evident in FIG. 1, are usually separated from cam wheels 18. However, in response to pressure against the spring resistance of resilient comb-like spring connector strip 34, they are able to be operationally or frictionally engaged to cam wheels 18 such that in response to the corresponding rotation of the wheels for fine adjustment 36, each associated cam wheel is rotated relative to the corresponding associated disk 28 and drive spindle 16. This action results in the fine adjustment.

FIG. 1 also shows parts 38 and 40 of the actuators for a separate quick release of the drive. These operate together with a corresponding switch for quick release—not shown here.

The numerous individual components 10 of the path simulator are able to be accommodated in an enclosed form within compact housing 12, 14—a design which allows for overall ease of assembly or disassembly.

As has been described above, both a rough adjustment and also a fine adjustment of cams 20 are possible. These adjustments may be advantageously performed without any tools. The use of an O-ring 30 between linked cam wheels 18 and rotationally fixed disks 28 means that a fixing of the set position for corresponding cam 20 by means of an additionally provided setscrew is not longer necessary. In addition, control components 38, 40 to actuate a controlled quick release may be retrofitted within the housing.

The invention claimed is:

1. System for controlling a motor drive of a garage door panel, comprising a single housing or constructional unit (12), a drive spindle (16) mounted within and to extend across an interior of said single housing or constructional unit (12), a series of cam wheels (18) mounted unon said drive spindle (16), a reduction gear (22) to which said drive spindle (16) is rotationally fixed within said single housing or constructional unit (12), a rough adiustment wheel (32) mounted upon each said cam wheel (18) in said series, a comb-like spring connector strip (34) suspended across an interior of said single housing or constructional unit (12), and wheels (36) to effect fine adjustment resiliently mounted upon said comb-like spring connector strip (34) suspended in said single housing or constructional unit (12) to (i) project at least partially from said single housing or constructional unit (12), (ii) be rotated in response to pressure against spring resistance of said spring connector strip (34) such that each said wheel (36) operationally or frictionally engages a corresponding cam wheel (18) of said series, and (iii) be moved along with the corresponding cam wheel (18) in the operational or frictionally engaged position with respect to said drive spindle (16), to effect fine adjustment of cam position.

2. System according to claim 1, wherein each individual rotating cam is composed of a cam wheel which is frictionally engaged to a disk which is in turn rotationally fixed to a driven spindle.

3. System according to claim 2, wherein each said rough-adjustment wheel is molded on to the respective cam wheel, and projecting partially from the housing.

4. System according to claim 3, wherein multiple cam wheels may be provided in a side-by-side arrangement.

5. System according to claim 2, wherein multiple cam wheels may be provided in a side-by-side arrangement.

6. System according to claim 5, wherein said rough adjustment wheels (32) also each project from said single housing or constructional unit (12).

7. System according to claim 2, wherein said rough adjustment wheels (32) also each project from said single housing or constructional unit (12).

8. System according to claim 1, wherein one pair of wheels each is provided for the fine adjustment of one cam wheel.

9. System according to claim 8, wherein multiple cam wheels may be provided in a side-by-side arrangement.

10. System according to claim 9, wherein said rough adjustment wheels (32) also each project from said single housing or constructional unit (12).

11. System according to claim 8, wherein said rough adjustment wheels (32) also each project from said single housing or constructional unit (12).

12. System according to claim 1, wherein multiple cam wheels may be provided in a side-by-side arrangement.

13. System according to claim 12, wherein said rough adjustment wheels (32) also each project from said single housing or constructional unit (12).

14. System according to claim 1, additionally comDrising an actuator for quick release mounted in the housing.

15. System according to claim 14, wherein said rough adjustment wheels (32) also each project from said single housing or constructional unit (12).

16. System according to claim 1, wherein said rough adjustment wheels (32) also each project from said single housing or constructional unit (12).

* * * * *